US005232467A

United States Patent [19]

Child et al.

[11] Patent Number: 5,232,467

[45] Date of Patent: Aug. 3, 1993

[54] PROCESS FOR PRODUCING DRY, SULFUR-FREE, $CH_4$-ENRICHED SYNTHESIS OR FUEL GAS

[75] Inventors: Edward T. Child, Tarrytown; William L. Lafferty, Jr., Hopewell Junction; Robert M. Suggitt, Wappingers Falls; Frederick C. Jahnke, Rye, all of N.Y.

[73] Assignee: Texaco Inc., White Plains, N.Y.

[21] Appl. No.: 900,388

[22] Filed: Jun. 18, 1992

[51] Int. Cl.[5] ..... C10K 1/14; C10K 3/06

[52] U.S. Cl. ..... 48/127.3; 48/127.5; 48/197 R; 252/373

[58] Field of Search ..... 48/197 R, 202, 203, 48/206, 210, 211, 212, 215, 127.5, 127.1, 127.3, 198.1, 198.3, 180.1; 252/373; 423/226, 228, 229, 230; 60/50.2

[56] References Cited

U.S. PATENT DOCUMENTS

| | | | |
|---|---|---|---|
| 3,108,855 | 10/1963 | Moore | 423/229 |
| 3,419,369 | 12/1968 | Kelly | 48/127.1 |
| 3,709,669 | 1/1973 | Marion et al. | 48/215 |
| 3,719,749 | 3/1973 | Smith et al. | 423/228 |
| 3,728,093 | 4/1973 | Cofield | 48/197 R |
| 3,788,825 | 1/1974 | Arenson | 48/127.1 |
| 3,976,442 | 8/1976 | Paull et al. | 48/197 R |
| 3,989,811 | 11/1976 | Hill | 423/229 |
| 4,052,176 | 10/1977 | Child et al. | 48/197 R |
| 4,189,307 | 2/1980 | Marion | 48/197 R |
| 4,466,810 | 8/1984 | Dille et al. | 48/197 R |

*Primary Examiner*—Peter Kratz

*Attorney, Agent, or Firm*—James J. O'Loughlin; Albert Brent

[57] ABSTRACT

Cryogenic liquefied natural gas (LNG) is used as a source of refrigeration and methane in the production of dry sulfur-free, methane-enriched synthesis gas or fuel gas. Raw syngas is indirectly and directly contacted with cryogenic liquefied natural gas (LNG) and cooled thereby below the dew point. Water is thereby condensed out and separated from the process gas stream. Further, the liquid LNG vaporizes and increases the methane content of the dewatered synthesis gas. Cold liquid absorbent solvent contacts the dry $CH_4$-enriched synthesis gas in an absorption column and absorbs the acid gases e.g. $H_2S$ and COS and optionally $H_2S+COS+CO_2$. In a preferred embodiment, the rich solvent absorbent is regenerated in a stripping column and the released acid gases are sent to a Claus unit for the production of elemental sulfur. In a second embodiment, the regenerated lean liquid absorbent solvent may be mixed with the dry, purified synthesis gas leaving from the top of the absorption tower. This mixture is then directly and optionally indirectly contacted with additional cryogenic liquid LNG. The $CH_4$ content of the synthesis or fuel gas is thereby increased to a value in the range of about 10 to 80 mole %. By means of a decanter, dry, sulfur-free methane-enriched syngas product is separated from liquid absorbent solvent. The liquid absorbent solvent is then recycled to the absorption column.

21 Claims, 1 Drawing Sheet

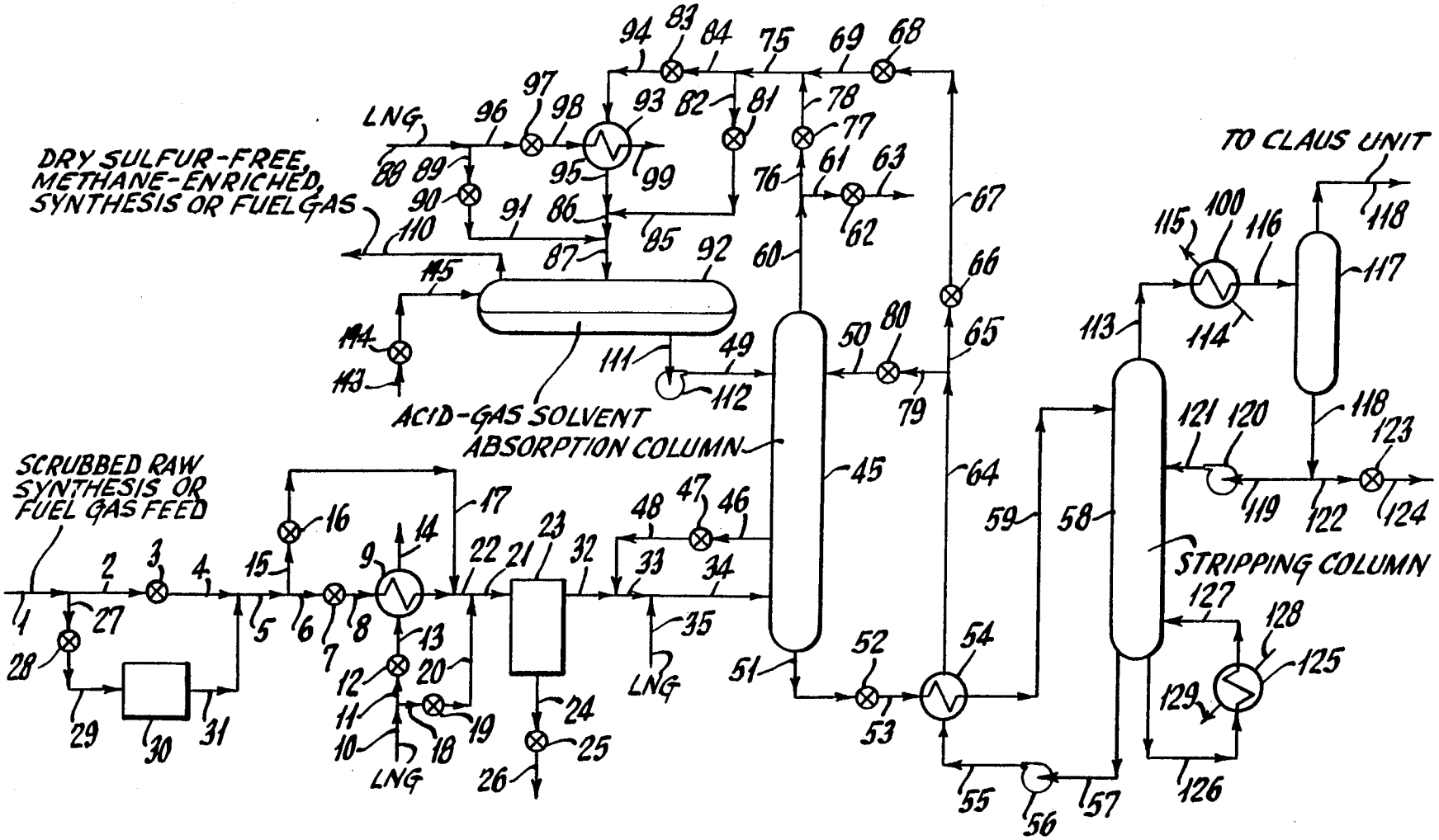
TO CLAUS UNIT
STRIPPING COLUMN
ACID-GAS SOLVENT ABSORPTION COLUMN
LNG
LNG
LNG
DRY SULFUR-FREE METHANE-ENRICHED SYNTHESIS OR FUEL GAS
SCRUBBED RAW SYNTHESIS OR FUEL GAS FEED

PROCESS FOR PRODUCING DRY, SULFUR-FREE, $CH_4$-ENRICHED SYNTHESIS OR FUEL GAS

FIELD OF THE INVENTION

This invention relates to the production of dry sulfur-free $CH_4$-enriched synthesis gas. Synthesis gas is used for the catalytic synthesis of organic chemicals or may be burned as a fuel.

Raw synthesis gas, substantially comprising mixtures of $H_2$, CO, $CO_2$, $N_2$, $H_2O$, $H_2S$ and COS, as produced from sulfur-containing fossil fuels by contemporary partial oxidation processes, may have a methane content in the range of about 0.1 to 2 mole percent and a maximum net heating value of about 300 BTU per standard cubic foot (SCF). All heating values are expressed herein on the dry basis. In some applications, it is desirable to increase the methane content of the synthesis gas, for example to increase its net heating value.

In coassigned U.S. Pat. No. 3,688,438, synthesis gas was made having up to 26 volume percent of methane by the partial oxidation of a hydrocarbonaceous fuel using comparatively high steam to fuel weight ratios and no subsequent catalytic methanation step. Costly removal of water from the product gas and production of the required steam was necessary. In coassigned U.S. Pat. No. 3,709,669, the synthesis gas leaving the partial oxidation gas generator is subjected to an additional step involving the catalytic water gas shift reaction to adjust the $H_2$/CO mole ratio to preferably 3 before catalytic methanation. In comparison with the prior art, by the subject invention a dry, sulfur-free, $CH_4$-enriched synthesis gas is produced without costly catalytic methanation, steam production or drying steps.

SUMMARY

A process for the production of dry, sulfur-free, $CH_4$-enriched synthesis gas or fuel gas comprising:

(1) cooling a particulate-free raw synthesis or fuel gas feedstream substantially comprising $H_2$, CO, $CO_2$, $H_2O$, $N_2$, $H_2S$, COS and with or without methane to a temperature in the range of about 60° F. to 130° F. and separating out at least a portion of water condensate;

(2) mixing together said cooled raw synthesis or fuel gas from (1) and a portion of cryogenic liquefied natural gas (LNG) thereby cooling said gas mixture to a temperature in the range of about −75° F. to 60° F.;

(3) directly contacting the mixture from (2) in an acid-gas removal zone with liquid acid-gas absorbent solvent thereby absorbing substantially all of the sulfur-containing compounds, the water, and optionally at least a portion of the $CO_2$, and thereby producing acid-gas rich liquid absorbent solvent containing dissolved water and a dry stream of methane enriched synthesis gas;

(4) separating said acid-gas rich liquid absorbent from said dry stream of methane enriched synthesis or fuel gas comprising $H_2$, CO, $CH_4$, optionally $CO_2$ and substantially no sulfur-containing gas or moisture; (5) regenerating the separated acid-gas rich liquid absorbent solvent to remove the sulfur-containing gas and the dissolved water; and (6) introducing said regenerated liquid acid-gas absorbent solvent into said acid gas removal zone.

DESCRIPTION OF THE INVENTION

The present invention involves an improved continuous process for the production of a dry, sulfur-free gaseous mixture substantially comprising hydrogen, carbon monoxide, methane, and with or without carbon dioxide; wherein, said gaseous mixture is suitable for use as fuel gas or as a process gas for the synthesis of organic chemicals. The product gas has a mole % $CH_4$ in the range of about 10 to 80 and a net heating value in the range of about 200 to 780 BTU per SCF.

The raw synthesis or fuel gas feed to the process is made by the partial oxidation of a sulfur-containing hydrocarbonaceous or solid carbonaceous fuel. Any particulate matter e.g. carbon soot and/or ash entrained in the gas stream leaving the partial oxidation reaction zone is removed when the gas stream is quench cooled or scrubbed with water. While any conventional partial oxidation process may be used, the Texaco partial oxidation process is preferred. For example, reference is made to U.S. Pat. No. 4,081,253, which is incorporated herein by reference.

The raw gaseous feedstock for the subject process, also referred to herein as raw synthesis or fuel gas, has the following composition in mole percent: $H_2$ 10.0 to 68.0, CO 15.0 to 60.0, $CO_2$ 1.0 to 30.0, $H_2O$ 2.0 to 50.0, $N_2$ nil to 60.0, $CH_4$ nil to 26.0, $H_2S$ 0.10 to 20.0, COS 0.10 to 3.0, and A nil to 1.8. If one or more ingredients are present in high amounts, the remaining ingredients are present in low amounts so that the total amount of ingredients equals 100 mole %. The net heating value is in the range of about 75 to 340 BTU/SCF. The temperature of the raw gaseous feedstock is in the range of about ambient to 700° F., such as about 100° F. to 550° F. and its pressure is in the range of about 1 to 200 atmospheres, such as about 3 to 125 atmospheres. Depending on its composition, the product gas may be called synthesis gas or fuel gas. For example, synthesis gas, also referred to herein as syngas, is rich in $H_2$+CO. While fuel gas also contains $H_2$ and CO, it also contains a greater amount of methane than syngas.

Liquefied natural gas, hereinafter referred to as LNG or liquid LNG to distinguish it from vaporized LNG has an atmospheric boiling point in the range of about −240° F. to −270° F. and for example, has the following composition range:

TABLE I

| Constituent | Mole Percent |
|---|---|
| Methane | 85–99.9 |
| Ethane | 0.1–7 |
| Propane | 0–5 |
| Butanes | 0–2 |
| Nitrogen | 0–1 |
| Other $C_5$ + hydrocarbons | 0–1 |

In one embodiment, synthesis gas or fuel gas for burning in the combustion zone of a turbo-combustor for producing mechanical and/or electrical power is produced in the partial oxidation gas generator. Optionally, the $CO_2$ content in the gas may be increased to a value in the range of about 10 to 40 mole % and the $H_2$ content may be increased to a value in the range of about 11 to 75 mole % by reacting the feedstream of clean water saturated raw synthesis gas in a conventional water gas shift reaction. In such case, the process gas stream is introduced into a conventional catalytic water-gas shift reaction zone where CO and $H_2O$ react at a temperature in the range of about 500° F. to 1050° F. over a conventional water-gas shift catalyst to produce $H_2$ and $CO_2$. Advantageously, any COS in the feed gas stream is converted into $CO_2$ and $H_2S$ during the water-gas shift conversion step. A suitable water-gas shift catalyst may comprise iron oxide promoted by 1 to 15 weight percent of an oxide of a metal such as chromium, thorium, uranium, beryllium and antimony. Alternatively, cobalt molybdate on alumina may be used as the water-gas shift catalyst at a reaction temperature in the range of about 500° F. to 840° F. Co-Mo catalysts comprise in weight percent CoO 2-5, $MoO_3$ 8-16, MgO nil-20, and $Al_2O_3$ 59-85.

Cooling the raw synthesis or fuel gas with cryogenic LNG, either indirectly through a heat exchanger and/or by direct injection of the LNG, was found to be a valuable way of recovering low value heat available at temperatures of about 330° F. to 350° F. (the saturation point of 115 psia steam is 338° F.). In one embodiment, prior to the aforesaid heat exchange with LNG, at least 100 to 125 psia steam is made with the higher temperature synthesis or fuel gas leaving the scrubber at 300° F. to 550° F., depending on the gasifier pressure, and being passed in indirect heat exchange with boiler feed water. The expression A and/or B is used herein in its ordinary sense and means A, or B, or a mixture of A and B.

In the process, the clean raw synthesis or fuel gas or optionally the water gas shifted clean raw synthesis or fuel gas is cooled to a temperature in the range of about 100° F. to 130° F. and below the dew point of water by indirect and/or direct heat exchange, preferably with liquid LNG as the coolant. In such instance, vaporized LNG is produced and may be sent to a pipeline for distribution to gas consumers. From about 95 to 99.5 wt. % of the water contained in the clean raw synthesis gas stream is thereby condensed out and separated from the gas stream. The water was originally introduced into the raw synthesis or fuel gas during the partial oxidation reaction, during cleaning by quenching in water and/or scrubbing with water to remove particulate carbon and ash, and optionally prior to any water gas shift. Ordinarily, water is removed from the quenched and/or scrubbed raw gaseous stream by indirect heat exchange with a coolant in a separate heat exchanger. By the subject process, the size of this costly cooler may be reduced or eliminated, at a great economic advantage.

In the next step, the dewatered raw gaseous feedstock is mixed with a portion of liquefied natural gas (LNG) in liquid phase having a temperature in the range of about −270° F. to −100° F. and a pressure in the range of about 1 to 200 atmospheres. In this step, about 1 to 100 lbs, such as 30 to 80 lbs of liquid LNG are mixed with each thousand standard cubic feet (MSCF) of the raw stream of synthesis or fuel gas and is vaporized. Advantageously, the methane content of the raw stream of synthesis or fuel gas is raised to a value in the range of about 5 to 75 mole %. By direct heat exchange, the cryogenic LNG reduces the temperature of the gas stream to a temperature in the range of about −75° F. to 60° F.

Any conventional means may be used to introduce the liquid phase LNG into the raw stream of synthesis or fuel gas. For example, a "T" shaped fitting or mixing valve may be used. The LNG is vaporized thereby and a gaseous mixture is produced having a temperature in the range of about −75° F. to 60° F., such as about +10° F. and a pressure in atmospheres in the range of about 1 to 200. In one embodiment, a recycle portion of the liquid acid-gas absorption solvent taken from the absorption column, to be further described, is mixed with the raw syngas or fuel gas feed prior to the direct addition of the liquefied natural gas. For example, about 45 to 70 lbs of liquid absorption solvent may be mixed with each thousand standard cubic feet (MSCF) of raw syngas synthesis gas or fuel gas.

The dried $CH_4$-enriched synthesis gas or fuel gas at a temperature in the range of about −75° F. to 60° F., such as about +10° F. is then passed upwardly through a conventional trayed absorption tower where it is contacted with a down-flowing stream of conventional cold liquid acid-gas absorbent solvent at a temperature in the range of about −75° F. to 60° F., such as about +10° F. The pressure in the column is in the range of about 11 to 200 atmospheres, such as about 15 to 100 atmospheres. About 30 to 80 lbs of liquid absorbent solvent may be introduced into the absorption column per thousand standard cubic feet (MSCF) of syngas being processed therein. Substantially all of the liquid absorbent solvent that enters the absorption column and absorbs the acid gases, leaves from the bottom in liquid phase at a temperature in the range of about −65° F. to 70° F. This liquid absorbent solvent may be recycled and introduced into the top of the column, optionally in admixture with fresh make-up solvent, or regenerated solvent from a stripping column.

In one embodiment, spent solvent, also referred to herein as rich absorbent solvent, is regenerated by flashing in a stripping column. In the absorption column, the sulfur-containing gases e.g. $H_2S$ and any COS, along with $CO_2$, referred to herein collectively as acid-gases, in the synthesis or fuel gas mixture are absorbed by a liquid absorbent solvent and leave with the rich absorbent solvent at the bottom of the tower. In one embodiment, the rich absorbent solvent is introduced into the top of the stripping tower for regeneration. For example, the acid gases are driven off by heating the rich absorbent solvent to a temperature in the range of about 100° F. to 400° F. By this means, the content of $CO_2$ and sulfur-containing gases absorbed in the solvent may be reduced to low levels. With respect to flashing to liberate acid gases from the rich absorbent solvent, the regular pressure in the stripping column is in the range of about 10 to 100 psia.

The overhead stream from the stripping column comprising acid gases, about 0.5 to 10 mole % of $H_2O$, and a trace amount of vaporized absorbent solvent at a temperature in the range of about 100° F. to 350° F. is cooled below the dew point of water. The water condenses out and is separated from the acid-gases. In one embodiment, the overhead stream from the stripping column is cooled by indirect heat exchange with liquid LNG. The LNG may be thereby vaporized and sent to a pipeline for home or industrial use. The separated acid-gases are then sent to a conventional Claus Unit where by-product elemental sulfur is produced. The water is recycled to the stripping column.

Pipeline specifications for the desulfurized synthesis or fuel gas product e.g. ¼ grain of S/100 SCF of syngas product or about 4 ppm may be met by using a chemical absorbent solvent such as monoethanolamine (MEA), diethanolamine (DEA), triethanolamine (TEA), diglycolamine (DGA), methyldiethanol amine (MDE), or polyethylene glycol. In other applications, it may be desirable to use diisopropanolamine or methanol to remove $H_2S$ to very low levels without removing $CO_2$. Step-wise removal of acid gases while using two different absorbent solvents may be also used. Reference is made to coassigned U.S. Pat. No. 4,081,253, which is incorporated hereby by reference. A product gas stream of dry sulfur-free methane-enriched synthesis or fuel gas is thereby produced having a methane content of about 5 to 75 mole %.

In another embodiment, the treated stream of syngas leaving the absorption column at a temperature in the range of about −75° F. to 60° F., such as about −45° F. to 20° F., is passed in indirect and/or direct heat exchange with liquid LNG. In such case, about 0.6 to 10, such as about 1.3 lbs of liquid LNG at a temperature in the range of about −270° F. to −240° F. are introduced for each MSCF of syngas or fuel gas. By this means, a dry sulfur-free methane-enriched product gas stream is produced having a methane content in the range of about 10 to 80 mole % methane.

In still another embodiment, regenerated lean liquid acid-gas absorbent solvent at a temperature in the range of about 250° F. to 350° F. from the bottom of the stripping column is cooled to a temperature of about −10° F. to +100° F., such as about 30° F. to 60° F. by being passed in indirect (noncontact) heat exchange with the rich absorbent solvent which leaves from the bottom of the absorption column at a temperature in the range of about −75° F. to 60° F. From about 0 to 100 mole %, such as about 25 to 75 mole %, of the cooled lean liquid absorbent solvent is then mixed with the overhead stream of syngas leaving the absorption column at a temperature in the range of about −65° F. to 70° F., such as about +10° F. to +20° F. The remainder of the lean liquid absorbent solvent is introduced into the upper end of the absorption column. For example, from about 30 to 80 lbs of regenerated absorbent solvent are mixed with each MSCF of said syngas or fuel gas leaving the absorption column and the mixture is cooled to a temperature in the range of about −75° F. to 60° F. by indirect heat exchange with liquid LNG. The liquid LNG is vaporized and sent to a pipeline. Then about 0.6 to 10.0 lbs of liquid LNG are introduced into each MSCF of said syngas or fuel gas. The mixture of syngas or fuel gas, vaporized LNG, and entrained liquid absorbent solvent, at a temperature in the range of about −75° F. to 60° F., is introduced into a separation vessel. In the separation vessel, liquid absorbent solvent is separated from a dry sulfur-free $CH_4$-enriched stream of syngas or fuel gas product having the following composition in mole percent: CO 2.0 to 45.0, $H_2$ 1.0 to 50.0, $CH_4$ 10 to 80, $CO_2$ 0.5 to 30, $H_2O$ nil to 0.10, $N_2$ nil to 60.0, Ar nil to 1.8, and other gaseous hydrocarbons less than 10.

In one embodiment, the product gas stream of syngas or fuel gas at a temperature in the range of about −75° F. to 60° F. is passed in indirect heat exchange with clean raw synthesis or fuel gas feedstream after the latter has been cooled to a temperature of −55° F. to 100° F. This is done to exchange heat between the charge and effluent streams to the absorber to save heat.

The cold absorbent solvent is removed from the separation vessel and recycled to the upper portion of the absorption column.

The sulfur-containing raw synthesis or fuel gas used as feedstock to the subject process, as previously described, is preferably produced by the partial oxidation of a sulfur-containing liquid hydrocarbonaceous fuel or solid carbonaceous fuel with a free-oxygen containing gas optionally in the presence of a temperature moderator in the reaction zone of an unpacked free-flow non-catalytic partial-oxidation gas generator. The $H_2O$-to-fuel weight ratio in the reaction zone is in the range of about 0.1 to 5, and preferably about 0.2 to 0.7. The reaction time is in the range of about 1 to 10 seconds, and preferably about 2 to 6 seconds.

The term free-oxygen containing gas, as used herein is intended to include air, oxygen-enriched air, i.e. greater than 21 mole % oxygen, and substantially pure oxygen, i.e. greater than 95 mole % oxygen, (the remainder comprising $N_2$ and rare gases). Free-oxygen containing gas may be introduced into the burner at a temperature in the range of about ambient to 1,800° F. The ratio of free oxygen in the oxidant to carbon in the feedstock (O/C, atom/atom) is preferably in the range of about 0.7 to 1.5.

The raw synthesis gas stream exits from the reaction zone at a temperature in the range of about 1,800° F. to 3,000° F., such as 1,600° F. to 3,000° F., say 2,000° F. to 2,800° F. and at a pressure in the range of about 1 to 250 atmospheres (atm.), such as 10 to 200 atm. say 40 to 150 atm.

The synthesis gas generator comprises a vertical cylindrically shaped steel pressure vessel lined with refractory, such as shown in coassigned U.S. Pat. No. 2,809,104. A burner may be used to introduce the feed streams into the reaction zone.

A wide range of combustible carbon-containing organic materials may be reacted in the gas generator with a free-oxygen containing gas, optionally in the presence of a temperature-moderating gas, to produce the synthesis or fuel gas.

The terms liquid hydrocarbonaceous fuel and solid carbonaceous fuel as used herein to describe various suitable feedstocks to the synthesis gas generator is intended to include liquid, and solid hydrocarbons, carbonaceous materials, and mixtures thereof. In fact, substantially any combustible carbon-containing organic material, or slurries thereof, may be included within the definition of these terms. For example, there are (1) pumpable slurries of solid carbonaceous fuels such as coal, particulate carbon, petroleum coke; concentrated sewage sludge, and mixtures thereof, in a vaporizable liquid carrier, such as water, liquid hydrocarbon fuel, and mixtures thereof; (2) gas-solid suspensions such as finely ground solid carbonaceous fuels dispersed in either a temperature-moderating gas or in a gaseous hydrocarbon; and (3) gas-liquid-solid dispersions, such as atomized liquid hydrocarbon fuel or water and particulate carbon dispersed in a temperature moderating gas. The liquid hydrocarbonaceous fuel or solid carbonaceous fuel may have a sulfur content in the range of about 0.5 to 10 wt. percent.

The term "liquid hydrocarbon", as used herein to describe suitable liquid feedstocks, is intended to include various materials, such as petroleum distillates and residua, gasoline, naphtha, kerosine, crude petroleum, asphalt, gas oil, residual oil, tar-sand oil and shale oil, coal derived oil, aromatic hydrocarbons (such as benzene, toluene, xylene fractions), coal tar, cycle gas oil from fluid-catalytic-cracking operations, furfural extract of coker gas oil, and mixtures thereof.

Also included within the definition of the terms liquid hydrocarbonaceous fuel and solid carbonaceous fuel are oxygenated hydrocarbonaceous organic materials including carbohydrates, cellulosic materials, aldehydes, organic acids, alcohols, ketones, oxygenated fuel oil, waste liquids and byproducts from chemical processes containing oxygenated hydrocarbonaceous organic materials, and mixtures thereof.

The liquid hydrocarbonaceous fuel or solid carbonaceous fuel feed to the gasifier may be at room temperature, or it may be preheated to a temperature up to as high as about 600° F. to 1,200° F. but preferably below its cracking temperature. The hydrocarbonaceous feed may be introduced into the gas-generator burner in liquid phase or in a vaporized mixture with the temperature moderator.

The need for a temperature moderator to control the temperature in the partial oxidation reaction zone depends in general on the carbon-to-hydrogen ratio of the feedstock and the oxygen content of the oxidant stream. A temperature moderator is generally used with liquid hydrocarbonaceous fuels and with substantially pure oxygen. Steam may be introduced as the preferred temperature moderator in admixture with either or both reactant streams. Alternatively, the temperature moderator may be introduced into the reaction zone of the gas generator by way of a separate conduit in the burner. Other suitable temperature moderators may include $CO_2$ as produced subsequently in the process and a portion of cooled and recycled synthesis gas separated downstream in the process. In the case of carbonaceous solids slurried in water, the water becomes the temperature moderator in addition to the slurrying medium.

BRIEF DESCRIPTION OF THE DRAWING

A more complete understanding of the invention may be had by reference to the accompanying schematic drawing which shows an embodiment of the previously described process in detail.

Raw synthesis or fuel gas in line 1 was produced in a conventional free-flow non-catalytic refractory lined partial oxidation gas generator and cleaned by quenching in water and/or scrubbing with water. Accordingly, the raw synthesis gas is saturated with water. It is also available at a sufficiently high temperature so as to make at least 115 psia saturated steam (338° F.). Converting the higher level heat to intermediate pressure steam is usually the more economically desirable way of utilizing it and, although not shown on the drawing, it represents an embodiment of this invention.

The raw synthesis gas is passed through line 2 valve 3, lines 4, 5, 6, valve 7, line 8 and into exchanger 9 for indirect cooling by vaporizing LNG from lines 10, 11, valve 12, line 13, and then being passed through line 14 into a distribution line (not shown). Alternately, the vaporized LNG from line 14 may be used for further cooling of a warmer fluid before having it flow into a distribution line. Optionally, the stream of synthesis or fuel gas in line 5 may by-pass heat exchanger 9 by way of line 15, valve 16 and line 17.

Optionally, all or a portion of the liquefied natural gas entering line 10 may also be diverted through line 18, valve 19, and line 20 for direct mixing with the raw syngas or fuel gas in line 21 from line 22. Either option could apply or some combination of direct and indirect cooling may be used. The raw syngas, or CH. enriched gas in line 21 has been cooled below its dew point so that the condensed water may be separated from the vapor phase in knockout pot 23 which, in turn, is removed through line 24, valve 25 and line 26.

In one embodiment, it is desirable to maximize the $CO_2$ content in the gas stream because the product gas is used as a fuel gas in a turbo-combustor. Advantageously, less $NO_x$ is produced in the combustor due to the increased $CO_2$ content in the range of about 5 to 35 mole %. Accordingly, with valve 3 closed, the saturated raw synthesis or fuel gas feedstream in line 1 is passed through line 27, open valve 28, line 29, catalytic water-gas shift converter 30, and line 31. CO and $H_2O$ in the gas stream react in shift converter 30 to produce $CO_2$ and $H_2$.

The dry raw synthesis gas stream is passed through lines 32, 33, and is directly mixed in line 34 with a second charge of liquid LNG from line 35. The liquid LNG is thereby vaporized, and the temperature of the raw synthesis or fuel gas stream in line 34 is lowered. In one embodiment, a recycle stream of acid-gas solvent is removed from conventional vertical acid-gas absorption column 45, equipped with a plurality of plates (not shown), by way of line 46, valve 47, and line 48. This stream is mixed in line 33 with the dewatered raw synthesis or fuel gas feed stream from line 32 and is vaporized. It is then passed through line 34 where it is mixed with liquid LNG from line 35 and then into absorption column 45 as a vapor in admixture with the raw synthesis or fuel gas feedstream.

Cold liquid acid-gas absorbent solvent is introduced through line 49 and/or line 50 near the top of absorption column 45. As the raw syngas passes up absorption tower 45, it makes contact with the liquid absorbent solvent passing down tower 45. The liquid absorbent solvent absorbs substantially all of the $H_2S$ residual moisture, and COS; or depending on the solvent, $H_2S$, COS, and some $CO_2$ from the up-flowing dewatered raw syngas.

The rich absorbent solvent flows out the bottom of absorption column 45 through line 51 and valve 52, where its pressure is reduced and the acid gases begin to separate from the solvent and then through line 53 and heat exchanger 54. Upon being heated in exchanger 54 with the lean hot solvent from line 55. pump 56, line 57 and stripping column 58, more of the acid gases are separated from the absorbent before it enters the upper section of stripping column 58 by way of line 59. In one embodiment, the absorbent and acid gases in line 59 may flow into a flash drum (not shown) where a portion of the acid gases are separated and pass into line 59, thereby avoiding the extra load at the top of stripper column 58.

The dry, acid-gas depleted syngas or fuel gas product passes out of the upper end of absorption column 45 by way of lines 60, 61 valve 62 and line 63. This dry sulfur-free $CH_4$-enriched stream of product gas is at a temperature in the range of about −65° F. to 70° F. and comprises $H_2+CO$ and $CH_4$. The methane content is in the range of about 10 to 75 mole %. From about 0 to 100 wt. % of the regenerated liquid absorbent solvent from stripping column 58, line 57, pump 56, line 55, heat exchanger 54, lines 64, 65, open valve 66, line 67, open valve 68 and line 69 are mixed in line 75 with the acid-gas free synthesis gas from lines 60, 76, open valve 77, and line 78. The remainder, if any, of the lean absorbent solvent in line 64 is passed through line 79, valve 80, and line 50 into the upper section of absorption column 45. For example, for each part by weight of lean absorbent solvent passing through line 50, about 0 to 1 parts by weight of lean absorbent solvent passes up through line 65. This split is controlled by valves 66 and 80. For example, about 50 mole % of the regenerated lean absorbent solvent stream in line 64 is passed up through line 65 and the remaining 50 mole % is passed through line 79, valve 80, line 50 into absorption column 45. In a second embodiment additional liquid LNG is introduced into the gaseous mixture from line 75 comprising dry sulfur-free $CH_4$-enriched synthesis or fuel gas from line 78 and optionally regenerated lean absorbent solvent from line 69. Thus, with valve 81 in line 82 open and valve 83 in line 84 closed, the material in line 75 is passed through line 82, valve 81, lines 85, 86 and mixed in line 87 with LNG from lines 88, 89, open valve 90 and line 91. The temperature is reduced to the desired absorption temperature, compensating for any heat of solution from the absorption of any additional acid gas components such as $CO_2$. The gaseous and liquid material in line 87 is then introduced into separator 92.

Optionally, from 0 to 100 mole %, say about 25 to 75 mole % of the material in line 75 is cooled by indirect heat exchange with liquid LNG in heat exchanger 93 before said direct injection of liquid LNG in line 87. In such case the material in line 75 is passed through line 84, open valve 83, line 94, exchanger 93 and lines 95, 86 and 87. The split of the flow between lines 82 and 84 is controlled by valves 81 and 83. The LNG in liquid phase in line 88 is passed through line 96, valve 97, line 98, and heat exchanger 93. The vaporized LNG passes through line 99 into a pipeline for distribution. In the former case, exchanger 93 may be eliminated and the dry, acid-gas depleted syngas is enriched with $CH_4$ by direct injection of the LNG. However, it may be desirable to use indirect cooling in heat exchanger 93 to provide vaporized $CH_4$ in line 99 for use elsewhere in the system to provide additional cooling, for example in heat exchanger 100, or for distribution.

The mixture of dry sulfur-free methane enriched synthesis gas and liquid absorbent solvent in line 87 is passed into gas-liquid solvent separating vessel 92 at a temperature in the range of about −75° F. to 60° F. Dry, sulfur-free, methane-enriched synthesis or fuel gas product is removed through line 110 at the top of vessel 92. The methane content of this product gas stream is in the range of about 15 to 80 mole % and a net heating value in the range of about 350 to 780 BTU per SCF. It has a temperature in the range of about −75° to 60° F. Cold lean liquid absorbent solvent is removed through line 111 at the bottom of separating vessel 92 and pumped by way of pump 112 through line 49, into the upper section of absorption column 45. Make-up liquid acid-gas absorbent solvent is passed through line 143, valve 144, and line 145 into separating vessel 92.

With respect to the regeneration of the rich absorbent solvent, the pressure drop across valve 52 causes the acid gases to be released from the rich solvent in line 53 and the separation is further aided by heating the mixture in exchanger 54. Upon entering the upper section of stripping column 58 through line 59, the acid gases along with some $H_2O$ flashes through line 113. The mixture is cooled in exchanger 100 with a cooler medium, such as liquid or vaporized LNG, which enters cooler 100 through line 114 and leaves as a vapor at a higher temperature through line 115. The temperature of the gaseous overhead stream in line 116 is below the dew point of the $H_2O$ entrained therein. The $H_2O$ condenses out, and in admixture with the acid-gases, the mixture is passed through line 116 into knock-out pot 117. The acid-gases separate from the $H_2O$ in knock-out pot 117, and pass out through line 118 at the top of knock-out pot 117. The acid gases are sent to a conventional Claus Unit for the production of elemental sulfur. Water from the bottom of knock-out pot 117 is recycled to the upper portion of stripping column 58 by way of line 119, pump 120 and line 121. Optionally, a portion of the water is withdrawn from the system by way of line 122, valve 123, and line 124. The acid-gas depleted or lean liquid absorbent solvent leaves through line 57 at the bottom of stripping column 58. Heat exchanger 125 takes absorbent solvent from the bottom of stripping column 58 by way of line 126 and heats it up to a temperature in the range of about 150° F. to 600° F. and returns it to column 58 by way of line 127. The pressure in stripping column 58 is in the range of about 10 to 100 psia.

In an important embodiment, the raw synthesis gas in line 5 may be cooled by exchanging its heat with the dry sulfur-free methane-enriched synthesis gas product in line 110 through a heat exchanger. This embodiment will spare a comparable amount of LNG cooling through lines 11 and/or 18 and at the same time utilize some low grade heat as it is usually desirable to heat the dry sulfur-free synthesis or fuel gas product.

EXAMPLE

The following example is offered as a better understanding of the present invention, but the invention is not to be construed as limited thereto.

Synthesis gas for burning as a fuel in the combustor of a turbo-electric generator is produced by the partial oxidation of an aqueous slurry of coal with oxygen in a free-flow refractory lined partial oxidation gas generator. About 10,320 tons per day of coal is gasified to produce about 784.2 million standard cubic feet per day (MM SCFD) of synthesis gas or fuel gas. The fuel gas is burned by complete combustion with air in the combustor of a gas turbine that turns a generator which produces a nominal 1000 megawatts per day of electrical power. However, the fuel gas produced by the partial oxidation process using air and fed to the combustor of the gas turbine has such a low heating value that it degrades the performance of the gas turbine. By blending in LNG with the clean synthesis or fuel gas this deficiency is overcome. Further, the LNG would not have to be regasified by heat exchange with sea water which requires expensive corrosion resistant heat exchangers and pumps. In addition, the methane content and therefore heat content of the fuel gas is substantially increased. Air rather than expensive oxygen may be thereby used in the partial oxidation gas generator. Accordingly, the cost of producing electricity is reduced significantly.

A stream of raw synthesis gas made by the partial oxidation of an aqueous slurry of coal in a free-flow refractory lined syngas generator is cooled in a waste heat boiler, scrubbed with water and further cooled and partially dewatered to produce a clean stream of about 720 MM SCFD of syngas having a temperature of about 353° F., a pressure of about 570 psia, and the composition shown in column 1 of Table ᵀ (line 1 in the drawing). The syngas is further dewatered in the following manner: (a) indirect heat exchange with liquid LNG, or cold regasified LNG, (b) direct heat exchange with liquid LNG and separation of entrained water to produce syngas having a temperature of about +33° F. and the composition shown in column 2 of Table I (line 32 in the drawing) and (3) introducing a second portion of LNG into the dried syngas in line 33 to produce the composition shown in Column 3 of Table I (line 34 in the drawing). A total amount of 2,025,600 lbs per hr. of liquefied LNG comprising about 99.9 mole percent of $CH_4$ having a temperature of about −250° F. is introduced as follows: 1,942,000 lbs per hr. for indirect cooling in exchanger 9, and 83,600 lbs per hr. for the two separate direct introductions of LNG into the syngas stream in lines 21 and 34. The syngas is thereby cooled and the $CH_4$ content increased. The portion of LNG used to directly contact the syngas is thereby gasified and enters into an acid-gas absorption tower in admixture with the raw syngas at a temperature of about 102° F. In a preferred embodiment involving recycle, about 3,030 lbs/hr of liquid absorption solvent per MSCFD of raw syngas feed are removed from a plate located about ¼ of the way up from the bottom of the absorption tower and introduced into the raw syngas feed stream prior to the second direct mixing the stream of syngas with the stream of liquid LNG. The efficiency of the absorption tower is thereby improved. The mixture of gases rising in the absorption tower is contacted with 2,540,000 lbs/hr of cold lean absorption solvent e.g. polyethylene glycol which enters at the top of the absorption tower at a temperature of about +10° F. The rich absorption solvent leaves at the bottom of the absorption tower at a temperature of about 15° F. The pressure in the absorption column is about 480 psia. Substantially all of the $H_2S$ and COS in the raw syngas feedstream is absorbed by the liquid absorbent solvent. The composition of the product stream of synthesis or fuel gas leaving absorption column 45 is shown in Table I column 4 (line 63 of the drawing).

Preferably, the rich absorbent solvent is regenerated in a stripping column by stripping, flashing, heating or by combinations thereof. About 104,000 Lbs/hr of steam at a temperature of about 339° F. is introduced into the reboiler at the bottom of the stripping tower to heat the liquid absorbent solvent and to drive off the acid gases and $H_2O$. The acid gas e.g. $H_2S$ and COS with or without $CO_2$ and $H_2O$ leave from the top of the stripping column at a temperature of about 210° F. and may be sent to a Claus Unit for recovery of sulfur. The lean absorbent solvent leaves from the bottom of the stripping column at a temperature of about 280° F. and may be then recycled.

In another embodiment, additional acid gases are removed by directly contacting the dry treated synthesis or fuel gas from the top of the absorption column with additional liquid absorbent solvent and liquid LNG. For example, about 2,480,000 lbs of regenerated absorbent solvent are mixed with about 820 MM SCFD of dry $CH_4$-enriched acid-gas depleted syngas leaving from the top of the absorption tower. About 1,310,000 lbs per day of liquid LNG comprising about 99.9 volume percent $CH_4$ at a temperature of −250° F. are then mixed with said gas mixture to reduce the temperature to +10° F. Then in a separator, 850 MM SCFD of dry-sulfur free-$CH_4$-enriched synthesis or fuel gas product at a temperature of 10° F., a pressure of 450 psia, and a composition shown in column 5 of Table I (line 110 in the drawing) is separated from liquid absorbent solvent. The cold liquid absorbent solvent is then introduced into the top of absorption column 45.

By the subject process, a dry sulfur-free stream of syngas or fuel gas is produced containing about 18 mole percent $CH_4$. Further, the net heat content is increased from 261 BTU/SCF to 376 BTU/SCF or about 44%. The use of liquefied natural gas (LNG) as a refrigerant in this process replaces an ammonia refrigeration unit which is estimated to be about $10,000,000. The cost of purchasing "over the fence" refrigeration at 0.4¢/kwh would amount to about 5% of the cost of producing the electric power. Further, the LNG would not have to be regasified by heat exchange with sea water which requires expensive corrosion resistant heat exchangers and pumps. In addition, the methane content and therefore heat content of the fuel gas is substantially increased. Accordingly, the cost of producing electricity is reduced significantly.

TABLE 1

| | Mole % | | | | |
|---|---|---|---|---|---|
| Syngas Composition | Line 1 | Line 32 | Line 34 | Line 63 | Line 110 |
| CO | 34.97 | 43.59 | 41.17 | 42.24 | 40.71 |
| $H_2$ | 25.83 | 32.21 | 30.42 | 31.21 | 30.09 |
| $CO_2$ | 8.40 | 10.47 | 9.89 | 8.43 | 8.12 |
| $H_2O$ | 27.23 | 0.14 | 0.02 | 0.02 | 0.01 |
| $H_2S$ + COS | 0.76 | 0.94 | 0.89 | 0.03 | 0.02 |
| $CH_4$ | 0.16 | 9.35 | 14.49 | 14.87 | 17.97 |
| Ar + $N_2$ | 2.65 | 3.30 | 3.12 | 3.20 | 3.08 |
| Total | 100.00 | 100.00 | 100.00 | 100.00 | 100.00 |
| Net Heat of Combustion BTU/SCF | 261 | 319 | 352 | 356 | 376 |

The process of the invention has been described generally and by examples with reference to hydrocarbonaceous feedstocks of particular compositions for purposes of clarity and illustration only. From the foregoing it will be apparent to those skilled in the art that various modifications of the process and the raw materials disclosed herein can be made without departure from the spirit of the invention.

We claim:

1. A process for the production of a dry, sulfur-free methane enriched synthesis gas or fuel gas stream comprising:

(1) cooling a particulate-free raw synthesis or fuel gas feedstream comprising $H_2$, CO, $CO_2$, $H_2O$, $N_2$, $H_2S$, COS and with or without methane to a temperature in the range of about 60° F. to 130° F. and separating out at least a portion of water condensate;

(2) mixing together said cooled raw synthesis or fuel gas from (1) and a portion of cryogenic liquefied natural gas (LNG) thereby further cooling the new synthesis of fuel gas to a temperature in the range of about −75° F. to 60° F.;

(3) directly contacting the mixture from (2) in an acid-gas removal zone with liquid acid-gas absorbent solvent thereby absorbing sulfur-containing compounds, water, and at least a portion of the $CO_2$, and thereby producing acid-gas rich liquid absorbent solvent containing dissolved water and a dry stream of methane enriched synthesis or fuel gas;

(4) separating said acid-gas rich liquid absorbent from said dry stream of methane enriched synthesis or fuel gas comprising $H_2$, CO, $CH_4$, and substantially no sulfur-containing gas or moisture;

(5) regenerating the separated acid-gas rich liquid absorbent solvent to remove the sulfur-containing gas and the dissolved water; and (6) introducing regenerated liquid acid-gas absorbent solvent into said acid gas removal zone.

2. The process of claim 1 provided with the step of introducing said clean raw synthesis or fuel gas feedstream into a water-gas shift reaction zone to increase the $H_2$ and $CO_2$ content in the synthesis gas stream prior to said cooling step in (1).

3. The process of claim 1 wherein the cooling step in (1) is effected by direct addition of liquid LNG and/or by indirect heat exchange between said clean raw synthesis or fuel gas and a stream of liquid LNG.

4. The process of claim 3 wherein prior to said direct addition of liquid LNG and/or indirect heat exchange with liquid LNG, said clean raw synthesis or fuel gas is cooled by indirect heat exchange with a coolant.

5. The process of claim 4 wherein said coolant is boiler feed water which is converted into steam.

6. The process of claim 4 wherein said coolant is said dry stream of methane enriched synthesis or fuel gas.

7. The process of claim 3 where said LNG is vaporized by said indirect heat exchange and the vaporized LNG is introduced into a pipeline for distribution to gas consumers.

8. The process of claim 1 where in (2) about 1 to 100 lbs of liquid LNG are introduced into each thousand standard cubic feet of raw synthesis or fuel gas from (1).

9. The process of claim 1 wherein the entering temperature of said liquid acid-gas absorbent in (3) is in the range of about −75° F. to −60° F., the pressure in said acid-gas removal zone is in the range of about 11 to 200 atmospheres; and about 30 to 80 lbs of liquid absorbent solvent are mixed with each thousand standard cubic feet of synthesis or fuel gas.

10. The process of claim 1 where in (4) the temperature of said separated liquid absorbent solvent is in the range of about −65° F. to +70° F.

11. The process of claim 1, provided with the step of introducing a portion of liquid LNG at a temperature in the range of about −240° F. to −270° F., into the said dry stream of methane enriched synthesis or fuel gas from (4); and from about 0.6 to 10.0 lbs of liquid LNG are mixed with each thousand standard cubic feet of synthesis gas.

12. The process of claim 1 provided with the steps of cooling said dry stream of methane enriched synthesis or fuel gas from (4) by indirect heat exchange with a separate portion of liquid LNG at a temperature in the range of about −240° F. to −270° F. and/or introducing a separate portion of liquid LNG at a temperature in the range of about −240° F. to −270° F. directly into said dry stream of methane enriched synthesis or fuel gas from (4).

13. The process of claim 1 where the temperature of the gas leaving the acid-gas absorption column is in the range of about −75° F. to 60° F.

14. The process of claim 1 provided with the steps of heating and/or flashing the acid-gas rich liquid absorbent solvent from (3) to separate $H_2S+COS$ or $H_2S+COS$ and $CO_2$ and to produce regenerated liquid absorbent solvent; and contacting said dry stream of methane enriched synthesis or fuel gas from (4) with said regenerated absorbent solvent to remove additional $H_2S+COS$ or $H_2S+COS$ and $CO_2$.

15. The process of claim 14 provided with the step of introducing said $H_2S+COS$ or $H_2S+COS$ and $CO_2$ into a Claus Unit for the recovery of sulfur.

16. The process of claim 1 wherein said liquid acid-gas absorbent solvent in (3) is selected from the group consisting of monoethanolamine, diethanolamine, triethanolamine, diglycolamine, methyldiethanolamine, and polyethylene glycol.

17. The process of claim 1 wherein said liquid acid-gas absorbent solvent in (3) is methanol or diisopropanolamine.

18. A process for the production of a dry, sulfur-free methane enriched synthesis gas or fuel gas stream comprising:

(1) cooling a particulate-free raw synthesis or fuel gas feedstream comprising $H_2$, CO, $CO_2$, $H_2O$, $N_2$, $H_2S$, COS and with or without $CH_4$ to a temperature in the range of 60° F. to 130° F. by indirect heat exchange with a stream of LNG and/or by mixing with a portion of LNG; and separating out at least a portion of water condensate; (2) mixing together said cooled raw synthesis or fuel ,gas from (1) and a portion of cyrogenic liquified natural gas (LNG) thereby further cooling the raw synthesis or fuel gas to a temperature in the range of about −75° F. to 60° F.; to form a mixture wherein from 1 to 100 lbs of liquid LNG is introduced into each thousand standard cubic feet of said synthesis or fuel gas;

(3) directly contacting the mixture from (2) in an acid-gas removal zone with liquid acid-gas absorbent solvent thereby absorbing sulfur-containing compounds, water, and at least a portion of the $CO_2$, and thereby producing acid-gas rich liquid absorbent solvent containing dissolved water and a dry stream of sulfur-free methane enriched synthesis or fuel gas containing from about 5 to 75 mole % $CH_4$; wherein from 30 to 80 lbs of liquid absorbent solvent is mixed with each thousand standard cubic feet of synthesis or fuel gas;

(4) separating said acid-gas rich liquid absorbent from said dry stream of methane enriched synthesis or fuel gas comprising $H_2$, CO, $CH_4$, $CO_2$ and no sulfur-containing gas or moisture;

(5) cooling said dry stream of methane enriched synthesis or fuel gas from (4) by indirect heat exchange with LNG and/or by direct introduction of 0.6 to 10.0 lbs of LNG for each thousand standard cubic feet of methane enriched synthesis or fuel gas; thereby producing a dry stream of substantially sulfur-free methane enriched synthesis or fuel gas containing about 10 to 80 mole % of $CH_4$;

(6) regenerating the separated acid-gas rich liquid absorbent solvent from (4) to remove sulfur-containing gas and the dissolved water; and (7) introducing regenerated liquid acid-gas absorbent solvent into said acid gas removal zone.

19. The process of claim 18 provided with the step of introducing said particulate free raw synthesis or fuel gas feedstream into a water-gas shift reaction zone to increase the $H_2$ and $CO_2$ content in the synthesis or fuel gas stream prior to said cooling step in (I).

20. The process of claim 18 where said LNG is vaporized by said indirect heat exchange in (1) and (5) and the vaporized LNG is introduced into a pipeline for distribution to gas consumers.

21. The process of claim 18 wherein at least a portion of the regenerated liquid acid-gas absorbent solvent from (7) is mixed with the dry stream of methane enriched synthesis or fuel gas from (4); and provided with the steps of separating in a separating zone and removing liquid acid-gas absorbent solvent from said dry steam of sulfur-free methane enriched synthesis or fuel gas produced in (5) and introducing said separated liquid acid-gas absorbent solvent into said acid-gas removal zone.

* * * * *